US005240648A

United States Patent [19]

Gill et al.

[11] Patent Number: 5,240,648

[45] Date of Patent: Aug. 31, 1993

[54] COMPACT FOGGER

[76] Inventors: James G. Gill; Martin J. Becker, both of 5300 Melrose Ave., Ste. 201D, Hollywood, Calif. 90038

[21] Appl. No.: 835,559

[22] Filed: Feb. 14, 1992

[51] Int. Cl.[5] ..... B01F 3/04

[52] U.S. Cl. ..... 261/30; 261/78.2; 261/DIG. 65; 417/372; 239/590; 55/518

[58] Field of Search ..... 417/372; 261/30, 78.2, 261/DIG. 65; 239/590; 55/518, 482

[56] References Cited

U.S. PATENT DOCUMENTS 1,358,084 11/1920 Leigh .
1,895,765 1/1933 Muller .
2,651,172 9/1953 Kennedy .
2,809,073 10/1957 Wahlert .
2,887,181 5/1959 Dillon .
2,913,184 11/1959 Parlin .
3,111,273 11/1963 Mei .
3,207,386 9/1965 Presant et al. .
3,249,553 5/1966 Steinberg .
3,302,374 2/1967 Skekely .
3,348,825 10/1967 McIlvaine .
3,349,042 10/1967 Andrews .
3,419,658 12/1968 Saunders .
3,499,723 3/1970 Hamilson et al. .
3,672,126 6/1972 Goettle .
3,739,555 6/1973 Liebig .
3,954,921 5/1976 Yoshieda et al. .
4,063,900 12/1977 Mita et al. .
4,068,802 1/1978 Goings .
4,116,387 9/1978 Kremer, Jr. et al. .
4,271,100 6/1981 Trassy .
4,301,674 11/1981 Haines .
4,326,119 4/1982 Swiatosz .
4,330,422 5/1982 Tesch .
4,396,372 8/1983 Matumoto et al. .
4,492,533 1/1985 Tsuge ..... 417/372
4,585,398 4/1986 Drake ..... 417/372
4,784,585 11/1988 Hata et al. ..... 417/372
4,836,452 6/1989 Fox .
4,990,290 2/1991 Gill et al. ..... 261/30

*Primary Examiner*—Tim Miles
*Attorney, Agent, or Firm*—James Creighton Wray

[57] ABSTRACT

A compact special effects fogger has a small case with a handle on top for ease in transportation. A compressor box is positioned in the case against the base, and against one side and one end of the case. A fogger head box extends across the case on top of the compressor box. The two boxes form within the case a fan chamber at one end, a compressor cooling duct along one side, and an air entrainment duct along the top. A motor drives a compressor within the compressor box. A shaft from the motor extends into the fan chamber. A squirrel cage fan driven by the shaft draws air in through a round opening in the first end of the case and increases pressure in the fan chamber, causing air to flow through the ducts. The fogger head box has an oil sump and an oil intake is mounted in the sump. Oil tubes lead to a nozzle assembly within the fogger head. Compressed air flows through an air cooler in the compressor box and through a water trap in the fan chamber and into the nozzle assembly. The nozzle assembly releases an air-oil mist which flows through openings in an end of a U-shaped marble chamber to remove large oil droplets from the mist. The air and oil mist flows outward through a curved outlet, and then flows upward through an opening in the top of the fogger head box. Air flowing from the fan chamber through the air entrainment duct mixes with an entrains the mist and carries it outward through a full rectangular opening at the top of the second end of the case.

1 Claim, 5 Drawing Sheets

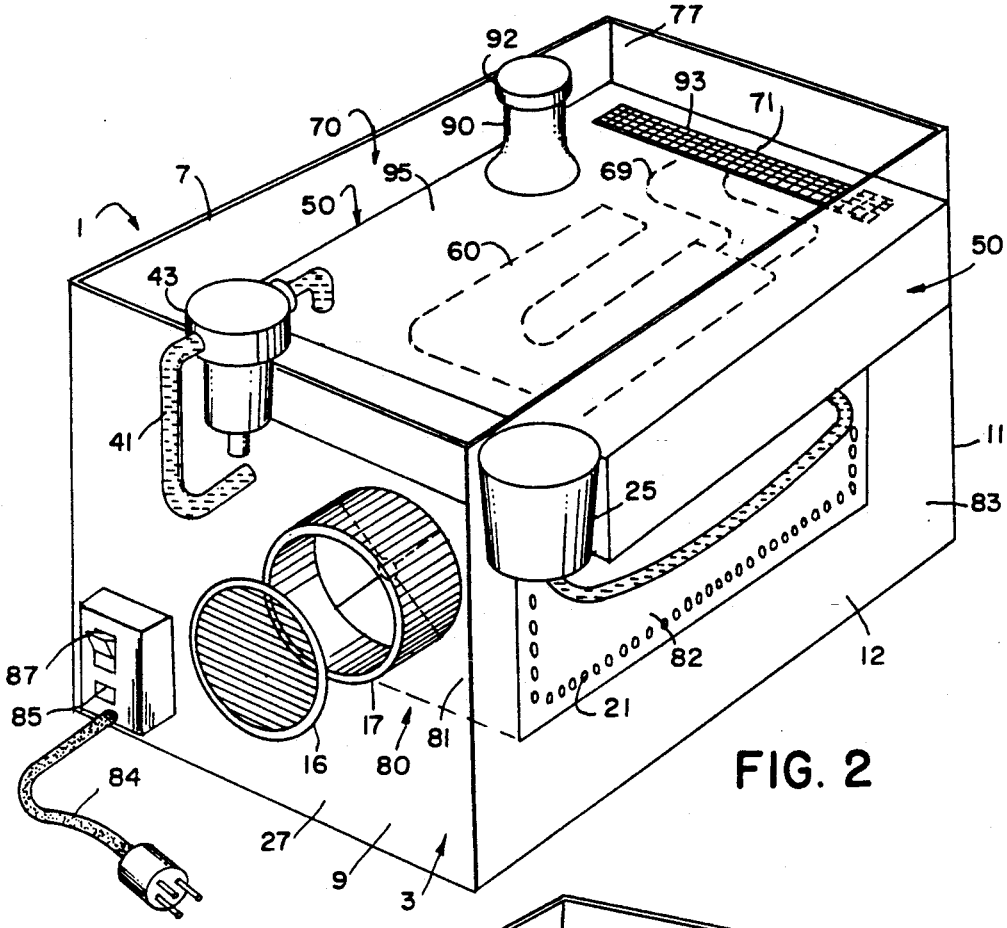
FIG. 2
FIG. 3
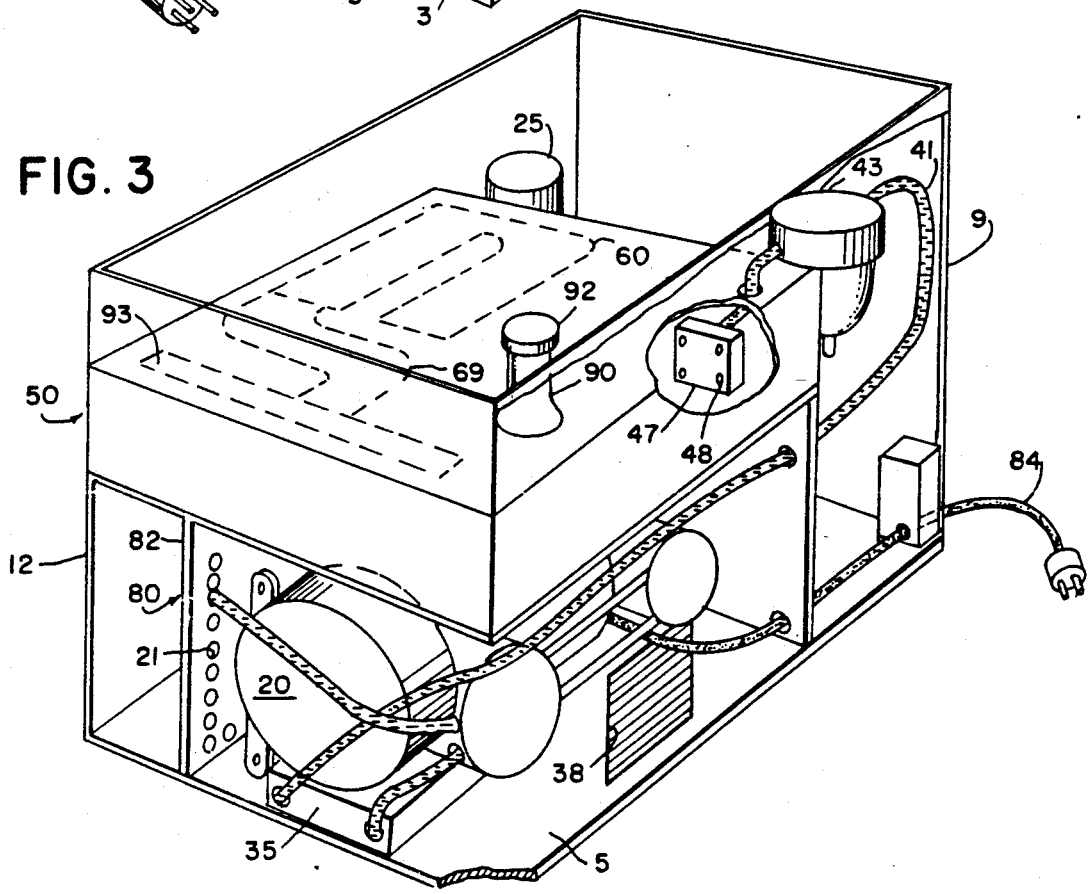

COMPACT FOGGER

BACKGROUND OF THE INVENTION

A fine stable mist is blown around a set or stage to produce desired special effects.

The inventors have produced successful products, first in 1986 a large Senior Diffusion Fogger was produced with great success. Later a Junior Diffusion Fogger was built into a road case for ease in transportation and rolling on location.

Description of the fog and background of the Diffusion Foggers are described in U.S. Pat. No. 4,990,290.

While the Diffusion Foggers have been highly successful and remain in use as state-of-the-art devices, a need exists for smaller, lightweight and compact Diffusion Foggers which may be easily carried by one person from place to place.

SUMMARY OF THE INVENTION

To fulfill that need, a small, compact fogger has been created by building two modular components within a small handheld case.

A compact special effects fogger has a small case with a handle on top for ease in transportation. A compressor box is positioned against the base, one side and one end of the case. A fogger head box is positioned on top of the compressor box, and the two boxes form within the case a fan chamber at one end, a compressor cooling duct along one side, and an air entrainment duct along the top. A motor drives a compressor within the compressor box and drives a shaft which extends into the fan chamber. A squirrel cage fan mounted on the shaft draws air in through a round opening in the first end of the case and increases pressure in the fan chamber, causing air to flow through the ducts. The fogger head box has an oil sump, and an oil intake is mounted in the sump. Oil tubes lead to a nozzle assembly within the fogger head. Compressed air flows through an air cooler in the compressor box, through a water trap in the fan chamber and into the nozzle assembly. The nozzle assembly releases an air-oil mist which flows through openings in an end of a U-shaped marble chamber to remove large oil droplets from the mist. The air and oil mist flows outward through a curved outlet, and then flows upward through an opening in the top of the fogger head box. Air flowing from the fan chamber through the air entrainment duct mixes with and entrains the mist and carries it outward through a rectangular opening at the top of the second end of the case.

A portable compact fogger has a two part case having a base, a top, first and second ends and first and second sides. An opening in a first end admits air to a fan chamber inside the first end. A fan mounted in the fan chamber draws air into the fan chamber. A compressor box mounted in the case has a top, a first end and a first side. The compressor box is mounted adjacent the base, the second end and the second side of the case and forms, with the case, a compressor chamber within the case. The fan chamber is positioned between the first end of the compressor box and the first end of the case. A compressor cooling duct is formed between the first side of the compressor box and the first side of the case.

A fogger head is positioned on top of the compressor box within the case. The fogger head has a rectangular box with a top spaced below the top of the case. A bottom rests on the top of the compressor box, and first and second sides contact the first and second sides of the case. A first end is spaced inward from the first end of the case, and a second end is positioned adjacent the second end of the case. Formed between the top of the fogger head box and the top of the case, an air duct extends between the fan chamber and a rectangular opening at an upper edge of the second end of the case. A compressor is mounted within the compressor box, and a compressor shaft extends through the first end of the compressor box. A fan in the fan chamber is mounted on an end of the shaft. Inlet openings in the compressor box flow air from the compressor cooling duct to the compressor. An outlet opening in the case flows compressor cooling air out of the compressor chamber. An air intake filter is mounted in the fan chamber. An intake line is connected to the intake filter and is connected to the compressor for supplying air to the compressor. A compressed air line connected to the compressor. An air cooler connected to the compressed air line is positioned near at least one opening in the compressor chamber for flowing air over the air cooler. An outlet line connected to the air cooler directs compressed cooled air to a nozzle positioned within the fogger head. An oil sump is in a bottom of the fogger head; an oil intake is in a bottom of the sump. Oil lines are connected between the oil intake and the nozzle for entraining and atomizing oil and forming an air-oil mist as air is released through the nozzle. A marble chamber is suspended from the top of the fogger head. Inlet openings in the marble chamber admit air-oil mist from the nozzle assembly. An outlet directs air and mist from the marble chamber. An opening in the top of the fogger head releases the air oil mist upward to the air duct and mixes the mist with air flowing through the duct for forming fog and for blowing the fog out through an opening in the second end of the case.

A preferred compact fogger has an extended shaft connected to a motor driven compressor. A squirrel cage fan is connected to the shaft. A fan chamber encloses the fan. An air duct leads from the fan chamber. An air intake and an air exhaust are connected to the compressor. A cooler is connected to the exhaust. Air stream directors direct air from the fan chamber over the compressor and cooler. An air line connects the cooler to a nozzle assembly. An oil supply is connected to the nozzle assembly for drawing oil into the nozzle assembly as air is released and atomizing the oil and forming a fine air-oil mist. An agglomerating chamber removes liquid oil from the mist. A mist exit port for releases mist from the chamber into the air duct, mixing the mist with air flowing through the duct for forming fog near an opening at an end of the air duct and for directing the fog out of the fogger.

The preferred method of forming fog in a compact fogger includes supplying power to a motor, driving a compressor with the motor and compressing air and cooling the compressed air in a cooler. A squirrel cage fan is driven with the motor, drawing air into a fan chamber and pressurizing the air. Releasing air from the fan chamber cools the compressor and cooler. Air flows from the fan chamber through an air duct. Cooled compressed air flows to a nozzle assembly. Releasing the compressed air through nozzles, draws oil into the nozzles, atomizes the oil with the air and forms a fine air-oil mist. Flowing the mist through an agglomerating chamber removes liquid oil from the mist. Flowing the mist into the air duct, mixes and entrains the mist with air in the duct to form a fog, which is blown out of an opening in an end of the air duct.

These and further and other objects and features of the invention are apparent in the disclosure, which includes the above and ongoing written specification, with the claims and the drawings.

BRIEF DESCRIPTION OF THE DRAWINGS

FIG. 2 is a perspective view of elements of the fogger taken from a top, a first end and a first side.

FIG. 3 is a perspective view of elements of the compact fogger taken from a top, a second end and a second side.

DETAILED DESCRIPTION OF THE DRAWINGS

Figure 1:
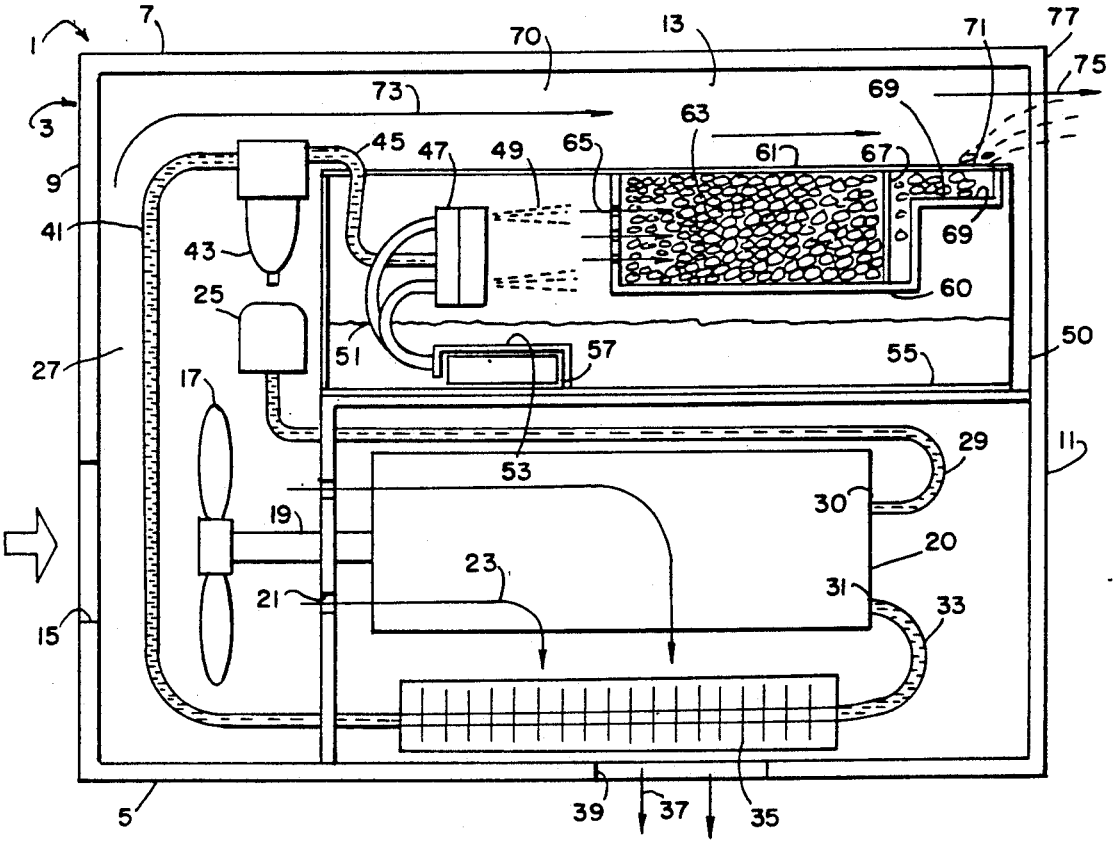
FIG. 1 is a schematic representation of a compact fogger of the present invention.

Referring to FIG. 1, the fogger is generally indicated by the numeral 1. Fogger 1 has a case 3 which has a base 5, a top 7, a first end 9 and a second end 11.

A first side has been removed to show the components of the compact fogger. A second side is indicated by the numeral 13.

An opening 15 in the first end admits air, which is drawn in by fan 17. Fan 17 is mounted on an end of shaft 19, which extends outward from a motor in compressor assembly 20. Air from the fan chamber flows through openings 21 to cool the compressor, as shown by arrows 23.

An air intake filter 25 in the fan chamber 27 supplies air to a compressor intake line 29 and to a compressor intake 30. Compressed air flows from compressor exhaust 31 through outlet 33 and air cooler 35.

The air 23 which cools the compressor also flows over the air cooler 35, and warm air 37 flows out through exit 39. The cooled compressed air flows through conduit 41 to a water trap 43, which removes water from the cooled compressed air. The compressed air then flows through air inlet line 45 to nozzle assembly 47. The nozzle assembly is mounted within a fogger head 50. Oil inlet lines 51 are connected to the nozzle assembly and to an oil intake 53, which is suspended above the bottom of an oil sump 55. The oil intake assembly 53 has peripheral openings 57 around its base which draw up oil into the oil lines 51. The spray nozzles 47 spray an air and oil mist mixture 49. The mist spray 49 flows through inlet ports 65 into a U-shaped marble chamber 60, which is suspended beneath the top 61 of the fogger head 50. Marbles 63 pick up and agglomerate large drops of oil from the mist flowing in through ports 65 and return the oil downward to the sump 55.

The fine mist passes out through screen 67 into exit chamber 69, and then passes upwardly through mist opening 71 into the air entrainment duct 70. Air 73 flows through duct 70 from the fan chamber 27. As the air 73 flows over the opening 71, it mixes with and entrains the air-oil mist flowing out of the opening and forms a fog 75. Fog flows out through opening 77 in an upper portion of second end 11 of the case.

FIG. 2 shows a perspective view taken from the first end 3, the first side 12, and the top 7 of the fogger 1. The fan is shown in its preferred embodiment as a high volume squirrel cage fan 17. The fan air inlet 15 has an inlet screen 16. The compressor is mounted in a compressor box 80 which has a first end 81 and a first side 82, which are spaced inward respectively from the first end 9 and the first side 12 of the outer case 3 of the fogger. The inward spacing of the compressor box walls forms the fan chamber 27 and a compressor cooling duct 83. Air flows from the fan chamber 27 into the compressor cooling duct 83 and out of the compressor cooling duct through openings 21 to cool the compressor 20 and the air cooler 35 shown in FIG. 1.

Power is supplied to the single motor which drives both the fan and compressor through an AC power cord 84, a circuit breaker 85, and a switch, preferably a lighted indicating switch, 87.

An oil filler tube 90 is positioned on top of the fogger head box 50, and a cap 92 is placed on top of the filler tube 90 so that oil may be added to the sump. An indicator may be viewed through the filler tube 90 to indicate oil level within the sump, or the cap 92 may have an attached dip stick.

A fine screen 93 is placed on top of the elongated mist opening 71. The fog release opening 77 extends across the entire upper portion of the second end 11 of the fogger case.

The fogger head box 50 extends across the entire fogger between side walls 12 and 13. The top 95 of the fogger head box and the inner surface of the top 7 of the fogger case 3 form the entrainment air duct 70.

In the perspective view in FIG. 3, the second end and second side walls have been removed to reveal inner part relationships. The fogger head box 50 is shown resting on top of the compressor box 80. Air inlets 21 provide cooling air and direct it over the cylinders of the compressor 20 over the compressed air cooler 35. A screen 38 is supplied over a cooling air release opening.

The nozzle assembly 47 as shown through the cutaway of the fogger head box has four nozzles 48.

Figure 4:
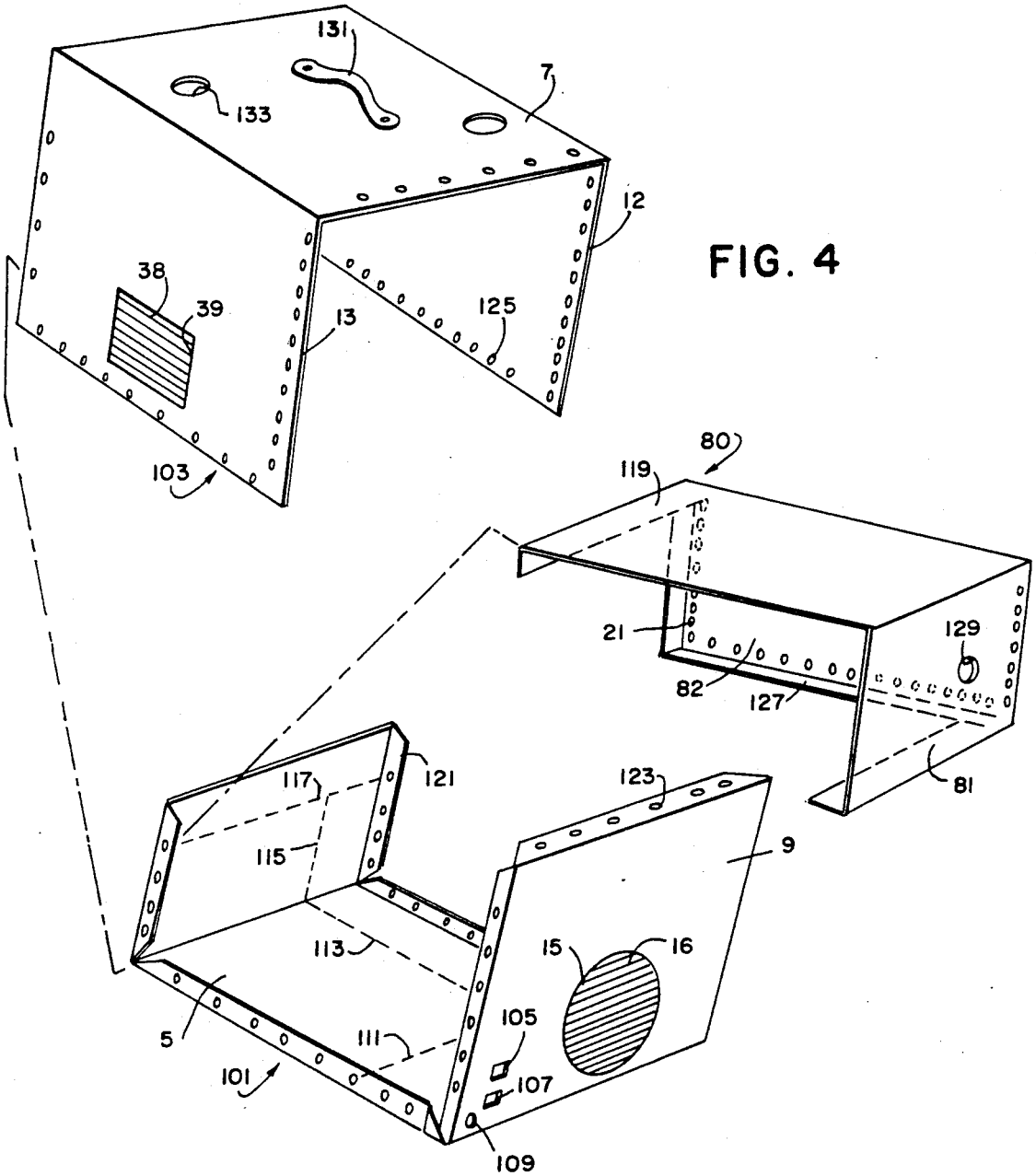
FIG. 4 is an exploded view of structural components of the case and the compressor box.

As shown in the exploded view of FIG. 4, the fogger case 3 is formed of a lower portion 101 and an upper portion 103. The lower assembly 101 has the base 5, first end wall 9 and second end wall 11. The second end wall 11 is shorter than the first end wall, so that the upper edge of the second end wall 11 forms a lower edge of the fog outlet 77. Screen 16 is shown in the air inlet opening 15 in the first end 9. Openings 105, 107 and 109 are provided in a lower corner of the first end 9 for the switch, the circuit breaker and the power cord, respectively.

Dashed lines 111, 113 and 115 show positions of end and side walls 81 and 82 of compressor box 80. Line 117 shows the position of the edge of the top 119 of compressor box 80. Flanges 121 have fasteners 123, which cooperate with fasteners 125 along edges of the upper case assembly 103.

Flanges 127 on compressor box 80 rest on the bottom and second end wall of the lower case assembly 101. Opening 129 receives the extended compressor shaft which drives the fan 17. The flanges may be welded or bonded in place. Fasteners 123 and 125 may have complementary raised and recessed structures for aiding alignment and bonding. Alternatively, connectors 123 and 125 may be openings for receiving screws.

A handle 131 is provided on the top 7 of the upper assembly 103. A hole 133 receives the filler pipe.

Preferably the parts are joined by surface bonding. Once the unit has been assembled there is no reason to disassemble the unit. The air intake filter has a long life, and the water trap drains outside the case.

Figure 5:
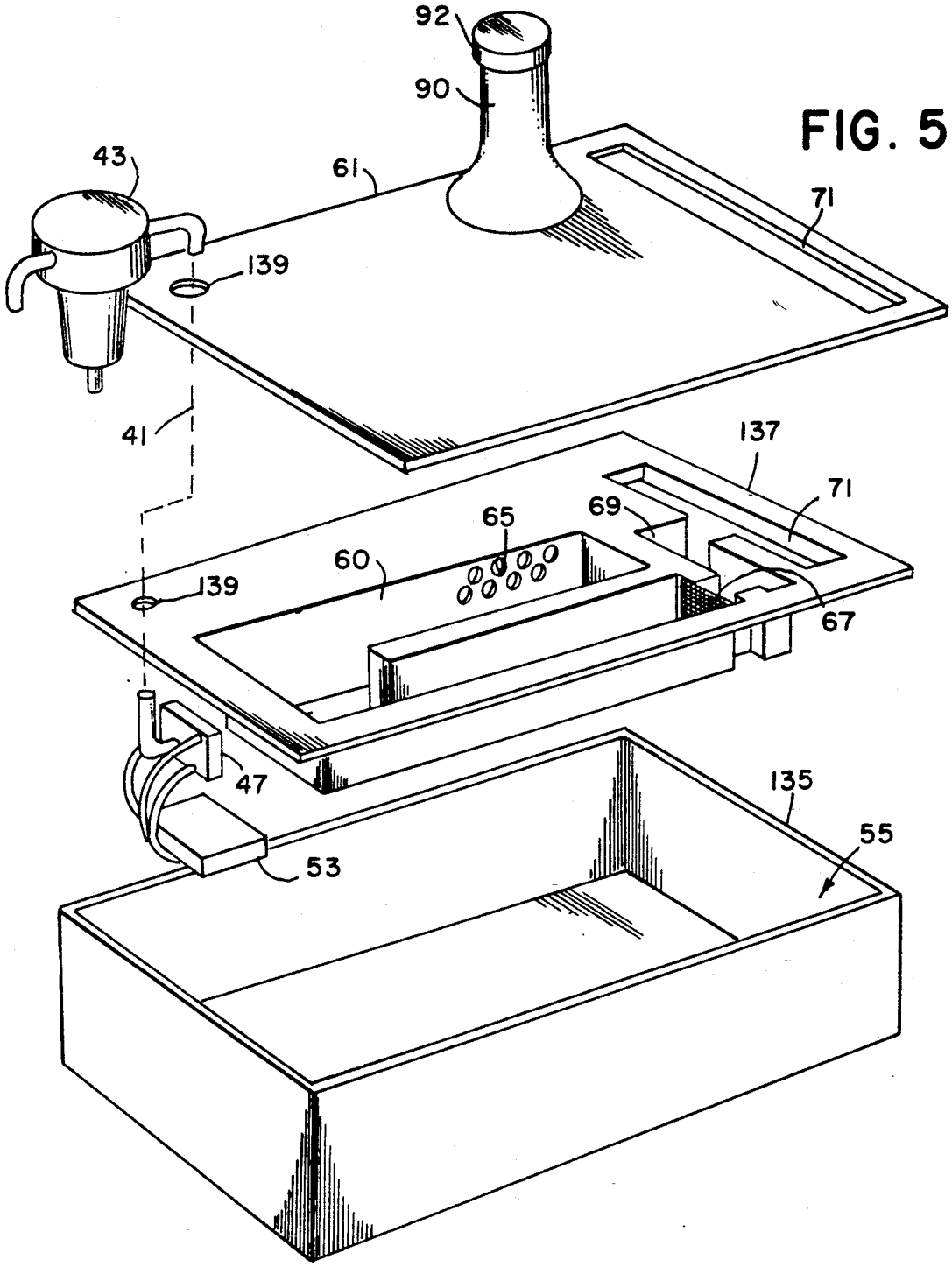
FIG. 5 is an exploded view of a fogger head.

As shown in FIG. 5, the fogger head 50 is preferably assembled of three molded parts. A lower sump case 55 has upper edges 135, which support edges of the intermediate molded assembly 137. The intermediate member has marble chamber 60, with preformed mist-admitting opening 65. Screen 67 is positioned at the outlet of the U-shaped marble chamber 60, and a molded outlet 69 directs the mist to outlet port 71. Holes 139 are aligned to admit the compressed air line 45 for connection to the nozzle assembly 47.

The top 61 has an integrally formed mist outlet port 71 and filler tube 90.

Figure 6:
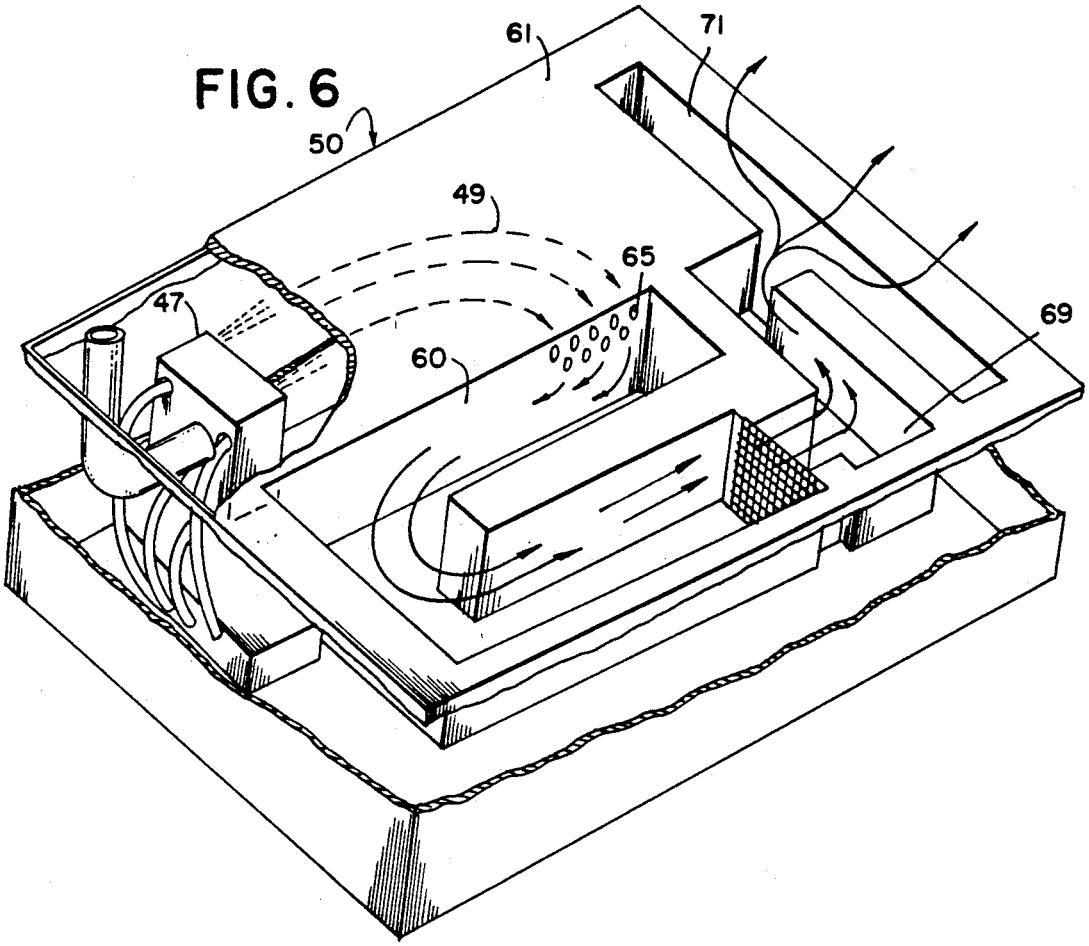
FIG. 6 is a perspective view of a fogger head taken from a top first end and first side of the fogger head.

FIG. 6 shows an assembled view of the fogger head 50.

Figure 7:
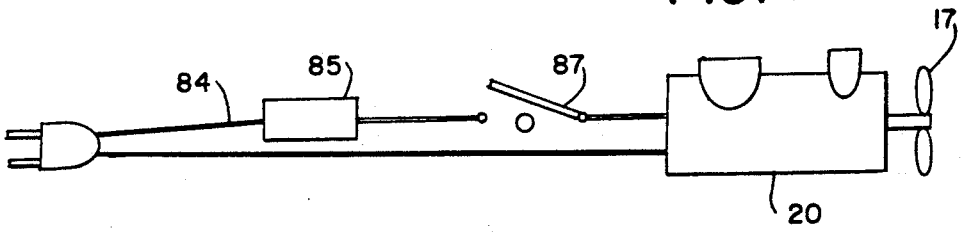
FIG. 7 is a schematic view of the power requirements of the compact fogger of the present invention.

FIG. 7 shows an electrical schematic of the power cord 84, circuit breaker 85, power switch 87, which is lighted when it is on, and the single driven element, the compressor motor, which drives the compressor and operates the fan.

While the invention has been described with reference to specific embodiments, modifications and variations of the invention may be constructed without departing from the scope of the invention, which is defined in the following claims.

We claim:

1. A portable compact fogger comprising a case having a base, a top, first and second ends and first and second sides, an opening in a first end for admitting air, a fan chamber inside the first end and a fan mounted in the fan chamber for drawing air into the fan chamber; a compressor box mounted in the case, the compressor box having a top, a first end and a first side, the compressor box being mounted adjacent the base, the second end and the second side of the case and thereby forming, with the case, a compressor chamber within the box, the fan chamber being positioned between the first end of the compressor box and the first end of the case, a compressor cooling duct between the first side of the compressor box and the first side of the case; a fogger head positioned on top of the compressor box within the case, the fogger head comprising a rectangular box with a top spaced below the top of the case, a bottom resting on the top of the compressor box and first and second sides contacting the first and second sides of the case, a first end spaced inward from the first end of the case, and a second end positioned adjacent the second end of the case, and forming between the top of the fogger head box and the top of the case an air duct extending between the fan chamber and a rectangular opening at an upper edge of the second end of the case; a compressor mounted within the compressor box and having a shaft extending through the first end of the compressor box, a fan mounted within the fan chamber on an end of the shaft, inlet openings in the compressor box for flowing air from the compressor cooling duct to the compressor, an outlet opening in the case for flowing compressor cooling air out of the compressor chamber, an air intake filter mounted in the fan chamber, an intake line connected to the intake filter and connected to the compressor for supplying air to the compressor, a compressed air line connected to the compressor, an air cooler connected to the compressed air line and positioned near at least one opening in the compressor chamber for flowing air over the air cooler, an outlet connected to the air cooler for directing compressed cooled air from the air cooler, a nozzle head positioned within the fogger head, an oil sump in a bottom of the fogger head, an oil intake in a bottom of the sump, oil lines connected between the oil intake and the nozzle for entraining and atomizing oil and forming an air-oil mist as air is released through the nozzle, a marble chamber positioned in the fogger head and suspended from the top of the fogger head, marbles positioned within the marble chamber, inlet openings in the marble chamber for admitting air-oil mist from the nozzle assembly, an outlet in the marble chamber for directing air and mist from the marble chamber, and a mist opening in the top of the fogger head for releasing the air-entrained oil mist upward to the air duct and mixing the mist with air flowing through the duct for forming fog and for blowing the fog out through an opening in the second end of the case.

* * * * *